US005513689A

United States Patent [19]

Montgomery, Jr. et al.

[11] Patent Number: 5,513,689

[45] Date of Patent: May 7, 1996

[54] METHOD OF MANUFACTURING BISMUTH SHOT

[75] Inventors: William S. Montgomery, Jr., Dallas, Tex.; William J. Doran, Arlington Hts., Ill.; Richard J. Ross, N. Kingstown, R.I.

[73] Assignee: Bismuth Cartridge, L.L.C., Dallas, Tex.

[21] Appl. No.: 388,390

[22] Filed: Feb. 14, 1995

[51] Int. Cl.[6] ..... B22D 17/04; B22D 17/22; B22D 25/02; B22D 31/00

[52] U.S. Cl. ..... 164/113; 29/1.22; 29/527.6; 164/129

[58] Field of Search ..... 164/113, 129, 164/69.1, 76.1, 269, 270.1; 29/527.6, 1.22

[56] References Cited

U.S. PATENT DOCUMENTS

| | | | |
|---|---|---|---|
| 1,746,236 | 2/1930 | Barton | 164/129 |
| 2,209,502 | 7/1940 | Annich | 29/527.6 |
| 4,949,644 | 8/1990 | Brown . | |
| 5,279,787 | 1/1994 | Oltrogge . | |

FOREIGN PATENT DOCUMENTS

| | | | |
|---|---|---|---|
| 1193645 | 5/1965 | Germany | 164/129 |
| 57-44449 | 3/1982 | Japan | 164/129 |
| 57-50268 | 3/1982 | Japan | 164/76.1 |
| 58-77767 | 5/1983 | Japan | 164/129 |
| 59-42167 | 3/1984 | Japan | 164/129 |

*Primary Examiner*—J. Reed Batten, Jr.
*Attorney, Agent, or Firm*—Fulbright & Jaworski

[57] ABSTRACT

A molten metal alloy, such as bismuth and tin, is injected into a die block to form a tightly packed rectangular array of shot pellets. The ratio of waste sprue to shot pellets is minimized and the shot pellet yield per casting is maximized by allowing the shot pellets in the rectangular shot array to touch other shot pellets in adjoining rows and columns through small interconnecting vias. The interconnecting vias allows the molten metal to flow between shot pellets, as well as from the sprue into the shot pellets. This allows the molten metal to bypass blockages that reduce the shot pellet count per casting. The flow of the molten metal through the die block is also improved by machining away a small amount of metal from the face of the die in order to form a flashing between the shot pellets.

49 Claims, 4 Drawing Sheets

FIG. 1
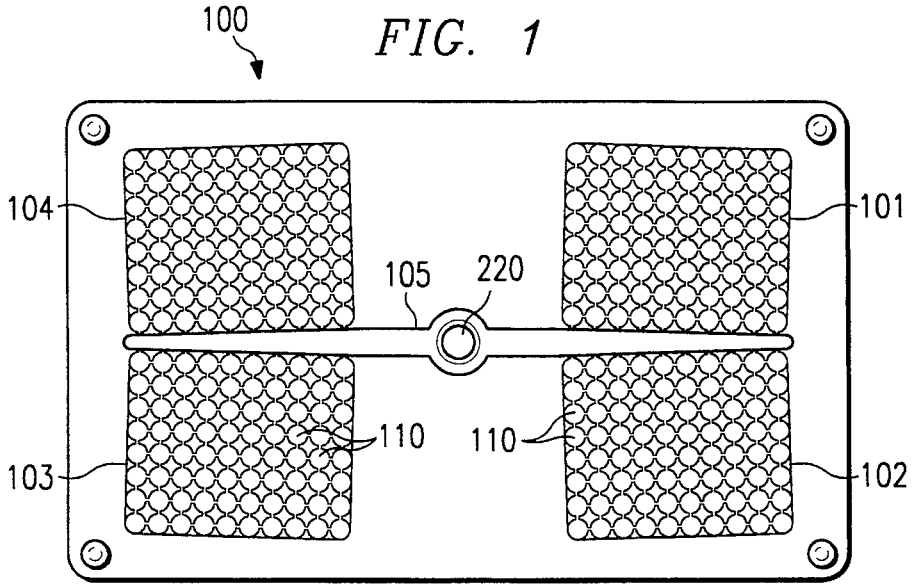
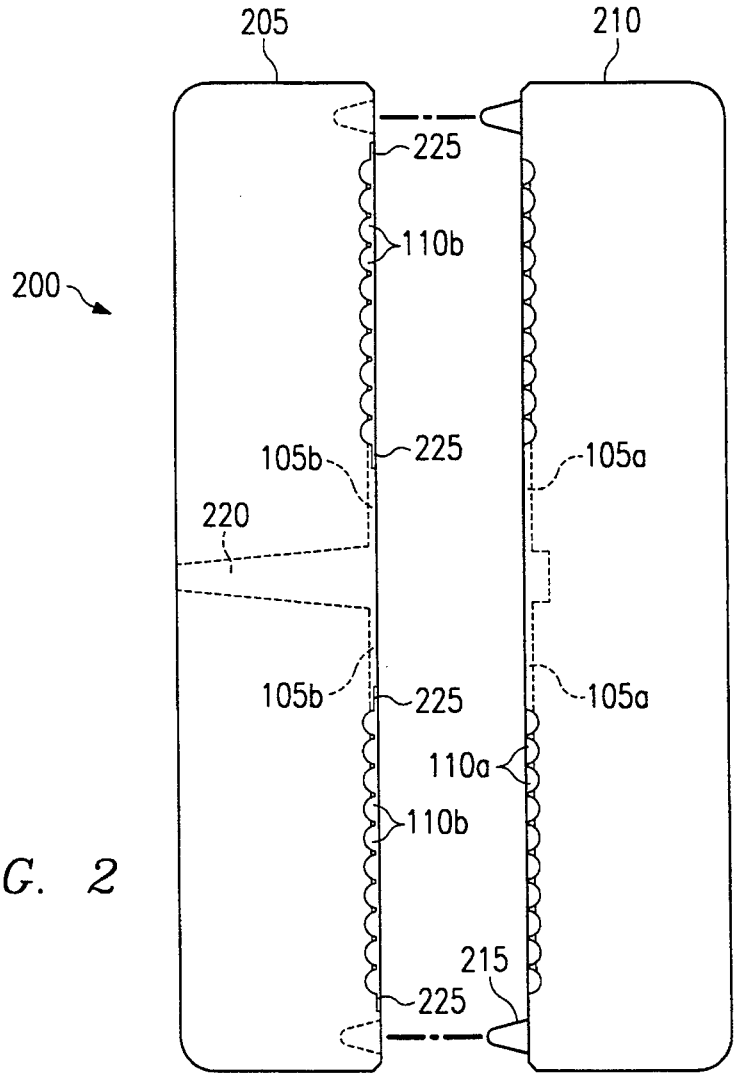
FIG. 2

METHOD OF MANUFACTURING BISMUTH SHOT

TECHNICAL FIELD OF THE INVENTION

This invention relates to a method of manufacturing non-toxic shot for shotgun shells and in particular to the die-casting of bismuth shot.

BACKGROUND OF THE INVENTION

In recent years there has been an increase in the demand for a non-toxic replacement for the traditional lead shot pellets used in shotguns. The use of toxic lead shot by hunters leads to the poisoning of many natural habitats, particularly the lakes and ponds where ducks, geese and other waterfowl are found. Presently, the only approved alternatives to lead shot are steel shot and bismuth-tin alloy, which are not toxic like lead. Unfortunately, steel shot has significant drawbacks compared to lead shot. Steel shot is much less dense than lead shot and therefore slows down much more rapidly than lead shot when fired. This makes hunting with steel shot less accurate because hunters must "lead" a moving target by a greater amount when using steel shot. Furthermore, because steel shot is so much lighter than lead shot, it causes far less shock and injury to the hunter's quarry. Rather than dying quickly after impact, the wounded animal will frequently run or fly a great distance before bleeding to death. Additionally, steel shot is more damaging to shotgun barrels because steel is harder than lead.

A more suitable replacement for lead is bismuth shot, in particular bismuth alloy shot. Bismuth may be alloyed with other metals, such as tin, to thereby produce bismuth alloy shot that is very nearly the same density as lead. Bismuth alloys are soft like lead and non-toxic. For these reasons, bismuth alloy shot does not damage shotgun barrels the way steel shot does and, because of its comparable density, has the accuracy and killing power of lead shot.

U.S. Pat. No. 4,949,644 to Brown discloses a non-toxic wildlife shot pellet for use in shotgun shells that is formed from bismuth or bismuth alloys. U.S. Pat. No. 5,279,787 to Oltrogge discloses methods of manufacturing and compositions of non-toxic projectiles containing bismuth, wherein the projectiles are made of high melting point powders mixed with molten metals of a low melting point to thereby produce a sintered metal projectile. These two prior art references are hereby incorporated by reference.

The principal drawback to using bismuth alloy shot is producing it economically in commercial quantities so as to be a viable replacement for lead shot. Unlike lead and steel, bismuth is highly crystalline and extremely nonductile. Bismuth also has a very low melting temperature and expands upon cooling. These metallurgical properties make it difficult or impossible to economically produce bismuth shot by conventional methods.

Normal shot sizes for hunting and shooting loads range from 0.008 inches to 0.33 inches. (No. 9 shot to No. 4 Buckshot) Conventional methods of making smaller sizes of shot (i.e., No. 9 to No. 6) are the drop method and the Bleimeister method (sometimes called the "short drop" method).

In the drop method, molten lead is poured through a screen at the top of a shot tower. The "screened" lead chills and solidifies into spheres as it falls through the air before landing, typically, in a tank of cold water.

In the Bleimeister method, molten lead is pumped through a pair of arms having small orifices along their bottom surfaces. The arms are positioned about 4 inches above the surface of almost boiling water. Droplets of molten metal fall through the small orifices in the bottom of the arms into the water and then roll along the surface of inclined plane pine boards to form spherical beads of molten lead. The spherical beads of molten lead harden as they roll and then drop to the bottom of the water tank, cooling on the way down.

Bismuth is highly crystalline in nature and resists forming a sphere. Bismuth also expands when cooled and has a high degree of heat retention, which prevents it from cooling quickly enough to be made using the drop method. These properties make it impossible to manufacture large bismuth alloy shot pellets using the drop method and the Bleimeister method. It is also not possible to manufacture lead or steel shot greater than size No. 5 (0.12") using either of these methods.

Large lead shot is conventionally made by a process that extrudes lead wire which is then flattened into an oval ribbon by a pair of rollers. The flattened oval ribbon is run through a pair of die wheels that punch out spheres of the appropriate size. Round steel shot is made by drawing a wire and snipping it into short segments using a header machine. The header machine then grinds the short chunks of steel wire into spheres.

Because of the nonductility of bismuth and bismuth alloys, it is not commercially feasible to make bismuth alloys into wire. Therefore, neither the header machine process nor the ribbon tape process may be used to make bismuth shot because both processes require that the bismuth alloy first be extruded into a wire.

The shortcomings of the previously discussed methods of manufacturing bismuth alloy shot leads to the conclusion that one method of manufacturing bismuth alloy shot that has a chance to produce shot economically for commercial use is to use high-speed die casting machinery capable of producing large quantities of shot in a short time frame. The manufacturing cost of bismuth shot is very critical due to the greater cost of raw bismuth compared to lead. The cost of bismuth is typically ten times that of conventional materials such as steel and lead. Thus, any die casting process must yield a high product to waste ratio.

Analysis revealed that manufacturing costs of $5 a pound on top of raw material costs would probably result in shot shells that were too expensive to be commercially acceptable to purchasers. Given the purchase price (or lease cost) of commercially available high-speed die casters and the operating costs associated with the die casters, it was determined that a minimum production level of at least a hundred pounds per hour of bismuth alloy shot had to be attained. Unfortunately, there were no die-blocks commercially available for producing shot made from bismuth alloy. The initial die-blocks custom fabricated for the inventors using traditional die design techniques failed to produce an acceptable number of shot pellets per casting in order to attain one hundred pounds of shot pellets per hour.

For example, number 4 shot requires approximately 1600 pellets per pound, at a rate of 100 pounds per hour, to be commercially viable. Traditional mold design techniques used to cast small parts cannot attain these numbers because they have an unacceptably high ratio of sprue and runner material to shot pellets. For example, in most cases, approximately 70% of the metal injected into the die block forms sprues and runners to which the shot pellets are attached.

These sprues and runners are waste metal that is remelted in the melting pot and represent a cost of approximately $3.11 per pound of waste per casting, exclusive of any other manufacturing costs.

Conventional high speed die casters and die blocks were also found to be unsuitable for casting bismuth alloy shot pellets because the heat retention of the bismuth increased the cycle time of the machines, minimizing production rates. Also, the expansion of bismuth when cooled was in part responsible for slowing down the flow of the material through the die block.

There is therefore a need for a method of quickly and economically manufacturing shot made from bismuth and bismuth alloys in various sizes.

SUMMARY OF THE INVENTION

The foregoing problems inherent in the prior art methods of manufacturing shot are solved by the present invention, which provides a method of die casting bismuth alloy shot in commercial quantities at an economical cost.

The problems inherent in commercially available high speed die casters and die blocks are solved by using a die block that casts an array of tightly packed shot pellets using a minimum amount of sprue. The shot pellets in one embodiment form an array around the sprue, wherein each pellet in the pellet array touches at least two other pellets and often four other pellets. Thus, as the molten bismuth alloy flows out of the sprue into the pellet cavities within the die block, the molten bismuth alloy flows between shot pellets thereby bypassing blockages and flowing a greater distance away from the sprue before solidifying. This produces a higher yield of good pellets per cast and also allows the use of a larger die capable of producing more pellets per cast.

A further improvement on conventional die blocks includes the machining away of approximately 0.0015 inches of material from both die faces so as to form a narrow gap, or "fill void," across the entire die surface, thereby allowing a thin "flashing" to form between all pellets in the shot pellet array. The combination of the multiple contact points between shot pellets in the array and the fill void allows the molten bismuth alloy to flow from the common sprue to the outer limits of the die much more quickly, before the molten bismuth alloy is able to solidify. The fill void and multiple contact points between shot pellets significantly reduces the sprue needed to spread the molten bismuth alloy throughout the die, while at the same time ensuring that the die is completely filled during each die casting. A less than complete fill results in partially hollow shot pellets, broken shot pellets, or a reduced number of pellets per cast due to empty, or partially empty cavities in the array.

After each shot pellet array is cast, the array is ejected from the mold and gathered into a container. The container is then dumped into a tumbling device containing tumbling media, such as ball bearings, in order to break up the shot pellet array, which resembles a sheet of pellets. The tumbling pulverizes the flashing between the shot pellets into a fine powder. The tumbling also grinds off the small "nipples" that are formed at the contact points between the shot pellets in the array. The tumbling process smoothens the properly formed pellets into nearly smooth spheres. Any imperfectly formed pellets or hollow pellets are pounded flat during tumbling.

After tumbling, the shot is sifted through a sifting screen to eliminate all metal pieces that are not shot pellets, such as the sprues. Once sifted, the shot pellets are moved by a conveyor belt to the top of a shot classifier which rolls the shot pellets down a series of steps set at varying angles for varying shot sizes to thereby automatically discard all less-than-round shot pellets including the imperfectly formed and hollow pellets. The remaining shot is collected at the bottom of the classifier and is ready for commercial usage. The shot may be sold in bulk for reloading in the commercial marketplace or loaded into shells using conventional manufacturing methods.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 1 is a front view of a die face used in the present invention.

FIG. 2 is a side view of 2 die halves as used by the present invention.

DETAILED DESCRIPTION OF THE INVENTION

Figure 3:
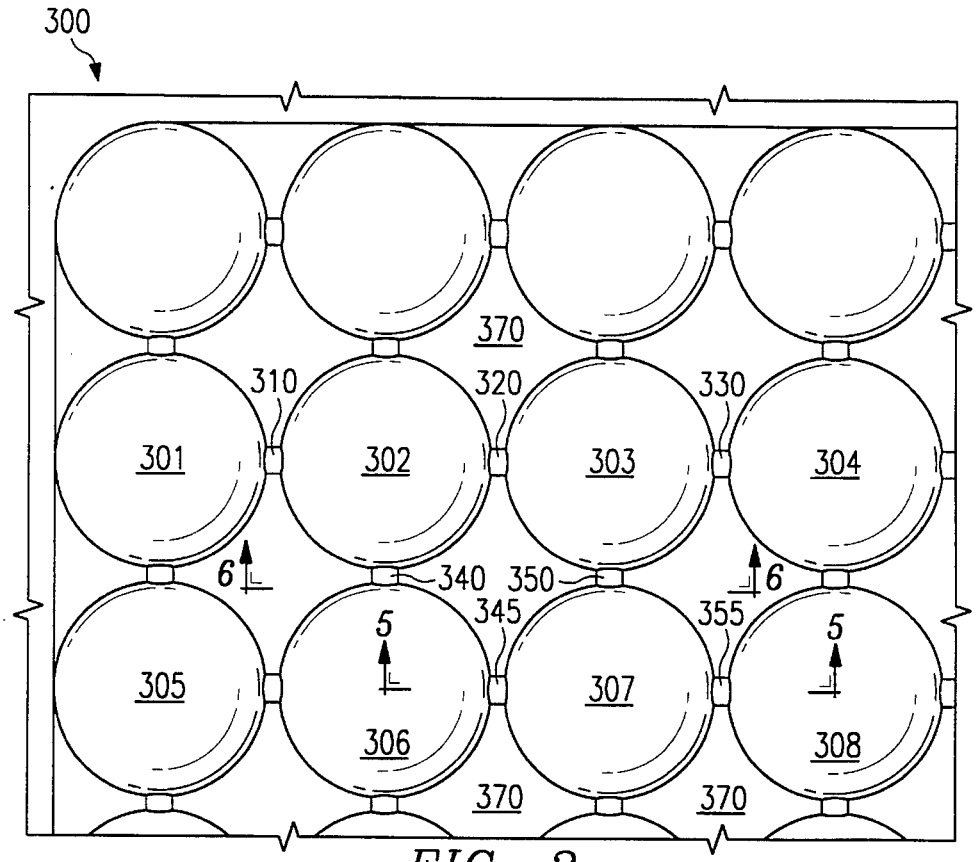
FIG. 3 is a plan view of a portion of the shot pellet array produced by the present invention.

The principles of the present invention and their advantages are best understood by referring to the illustrated embodiments depicted in FIGS. 1–7 of the drawings, in which like numbers designate like parts.

FIG. 1 depicts a die face 100 contained on a die block used to produce an array of shot pellets in accordance with one embodiment of the present invention. The embodiment of the present invention shown in FIG. 1 comprises four quadrants 101–104 of hemispherical impressions 110 connected to a central sprue channel 105 that is disposed along die face 100. Sprue channel 105 is connected to sprue hole 220, through which molten bismuth alloy is injected. The molten bismuth alloy flows along sprue channel 105 and into quadrants 104–105 of hemispherical impressions 110 disposed along sprue channel 105.

FIG. 2 depicts a side view of both halves of die block 200 used to produce shot pellet arrays in accordance with the present invention. Stationary die block 205 contains sprue hole 220 and sprue channel 105*b*. Stationary die block 205 also contains a number of hemispherical impressions 110*b*, each of which form one-half of a shot pellet. Movable die block 210 is the opposing mirror-image half of die block 200 that mates with stationary die block 205. Guideposts 215 are used to align movable die block 210 and stationary die block 205. Movable die block 210 contains sprue channel 105*a* which mates with sprue channel 105*b* in stationary die block 205 to thereby form sprue channel 105. Movable die block 210 also contains hemispherical impressions 110*a* which mate with opposing hemispherical impressions 110*b* in stationary die block 205, to thereby form the shot pellets in accordance with the present invention. In the embodiment of the present invention shown in FIG. 2, a small amount of metal has been milled from the face of stationary die block 205, thereby forming flashing gap 225. In some embodiments of the present invention, flashing gap 225 is formed by milling the surface of only one die face. In other embodiments of the present invention, flashing gap 225 may be formed by milling both die faces. In either embodiment, the flashing gap 225 that is formed between stationary die block 205 and movable die block 210 will typically be approximately 0.003 inches in thickness.

Additionally, in some embodiments of the present invention, either sprue channel 105*a* or sprue channel 105*b* may be omitted, so long as the remaining sprue channel is connected to sprue hole 220. Shot pellets may be produced by the present invention even if the sprue channel 105 is cut into only one die face and flashing gap 225 is also cut into only one die face, so long as the hemispherical impressions 110 in the die face are connected with the sprue channel 105.

FIG. 3 is an enlarged view of a shot pellet array produced by one embodiment of the present invention. Shot pellet array 300 contains shot pellets 301–308 which are connected by vias 310, 320, 330, 340, 345, 350 and 355. Shot pellets 301–308 are also interconnected by flashing 370. As molten bismuth flows through die block 200, it fills the cavities that form shot pellets 301–308 and flows between shot pellets 301–308 by means of vias 310–355 and flashing 370.

In another embodiment of the present invention, (not shown) vias 310–355 may be eliminated by packing the shot pellets 301–308 so tightly that the shot pellet 301–308 touch one another. This may be accomplished by positioning the center point of each hemispherical impression 110 in die face 100 sufficiently close to the center point of adjoining hemispherical impressions 110 so that the circumferences of the hemispherical impressions 110 overlap slightly. When the die blocks 205 and 210 are brought together, the overlaps in the circumferences of hemispherical impressions 110 will define holes between adjoining spherical cavities. Forming interconnections between the shot pellets 301–308 by this method allows the shot pellet 301–308 to be packed more tightly in die face 100, thereby producing a slightly higher yield of shot pellets per casting and further reducing the "waste" material.

However, this method also requires that the separation between the centers of the hemispherical impressions 110 in the die face 100 be very precisely located in order to accurately control the diameter of the hole connecting adjoining shot pellets 301–308. If the hemispherical impressions 110 overlap by too much or by too little, the hole formed between the spherical cavities in the die block 200 may be too narrow to allow the molten bismuth to flow freely therebetween, or so wide that it is difficult to break the shot pellets apart. This method, if not tightly controlled, could also result in flat surfaces on the pellets.

By using via channels 310–355 as shown in FIG. 3, it is easier to control the diameters of the interconnections between shot pellets 301–308, although the yield of shot pellets per casting will be slightly lower.

Figure 4:
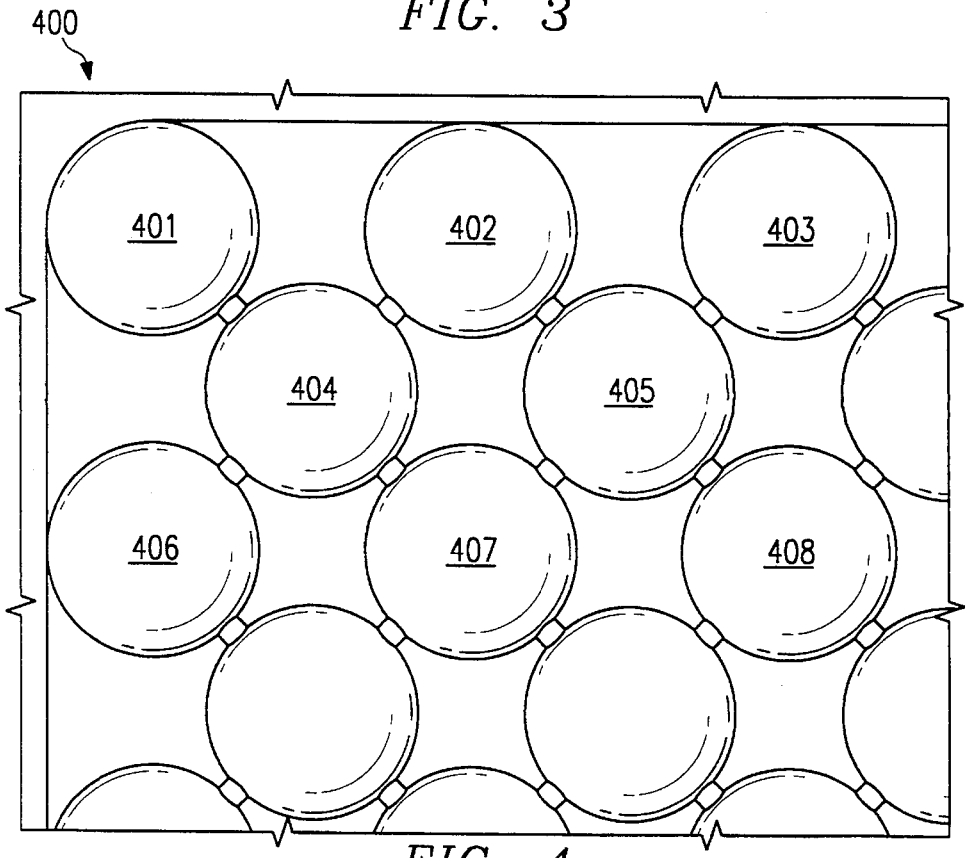
FIG. 4 is a plan view of a portion of a shot pellet array produced by the present invention wherein the rows of shot pellets are interlaced.

FIG. 4 depicts an alternative embodiment to the arrangement of shot pellet 301–308 shown in FIG. 3. In FIG. 4, shot pellets 401–408 are disposed in interlaced rows and columns of shot pellets. This allows a slightly tighter packing of shot pellets 401–408 than may be obtained using the rectangular grid of shot pellets 301–308 shown in FIG. 3. Of course, any grid configuration could be utilized, including oval, circular, or rectangular.

Figure 5:
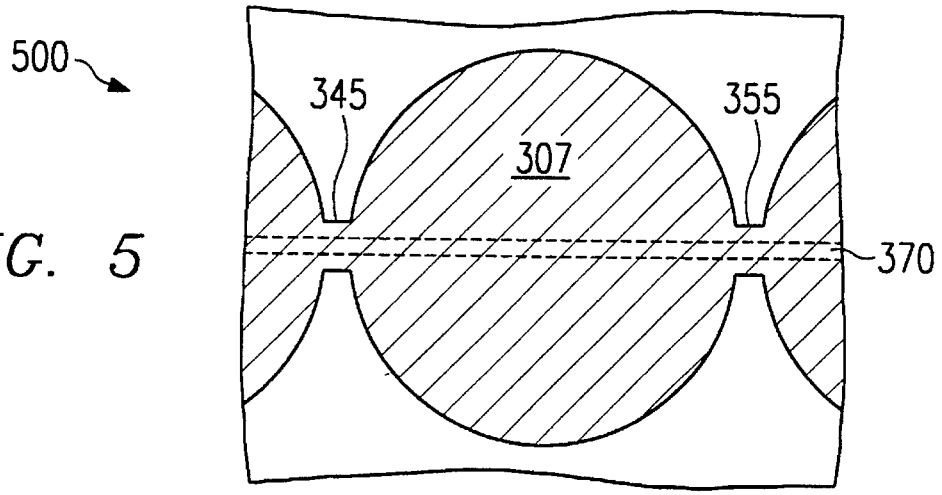
FIG. 5 is an elevational cross-sectional view of a shot pellet array produced by the present invention, taken substantially along line 5—5 of FIG. 3.
Figure 6:
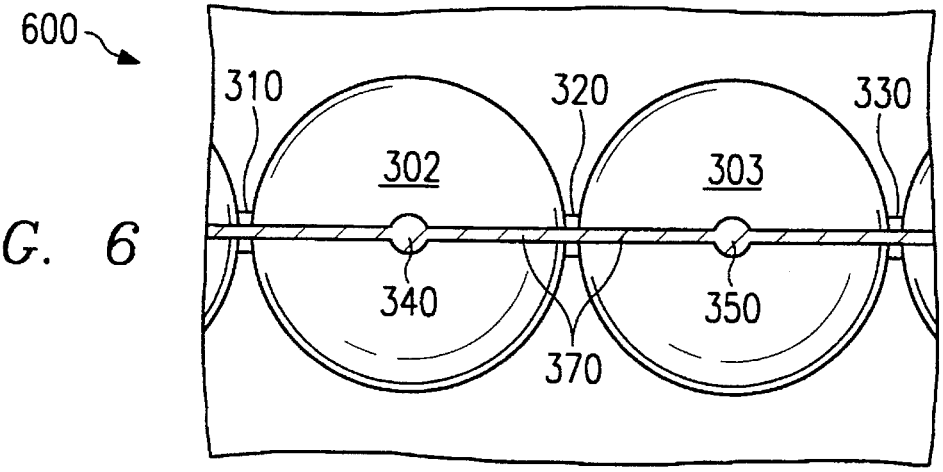
FIG. 6 is an elevational cross-sectional view of a shot pellet array produced by the present invention, taken substantially line 6—6 of FIG. 3.

The following explanation of FIGS. 5 and 6, which illustrate elevational cross-sectional views taken substantially along line 5—5 and line 6—6 through shot pellet array 300 as depicted in FIG. 3, also applies to the shot pellet array 400 depicted in FIG. 4. For the purpose of simplicity, however, FIGS. 5 and 6 will be explained with reference to the shot pellet array 300 shown in FIG. 3.

FIG. 5 illustrates elevational cross-sectional view 500 taken along line 5—5 through shot pellets 306, 307 and 308 in FIG. 3. Cross-sectional view 500 in FIG. 3 cuts through the center lines of via 345, via 355 and shot pellet 307. The two parallel dotted lines traversing the horizontal diameter of shot pellet 307 and the centers of via 345 and via 355 represent flashing 370, which interconnects all pellets in the shot pellet array. When via channels are cut in both die faces in stationary die block 205 and movable die block 210, via channels 345 and 355 will be centered on the horizontal diameters of the shot pellets 301–308. If the via channels are cut between hemispherical impressions 110 in only one die face, then via channels 345 and 355 will be disposed on only one side of the horizontal diameters of the shot pellets 301–308.

Similarly, if flashing 370 is formed by milling flashing gap 225 in both die faces of stationary die block 205 and movable die block 210, then flashing 370 will be centered around the horizontal diameters of shot pellets 301–308. If, however, flashing gap 225 is milled in only one die face, then flashing 370 will be disposed on only one side of the horizontal diameters of shot pellets 301–308. For purposes of further discussion, it will be assumed that the vias interconnecting the shot pellets in the shot pellet array were formed by cutting via channels in both die faces. It will also be assumed that flashing 370 was formed by milling flashing gaps in both die faces of die blocks 205 and 210.

FIG. 6 shows elevational cross-sectional view 600 taken along line 6—6 through shot pellet array 300. Cross-sectional view 600 in FIG. 6 cuts through flashing 370 and vias 340 and 350. Shown in the background of cross-sectional view 600 are shot pellets 302 and 303 and interconnecting vias 310, 320 and 330.

Figure 7:
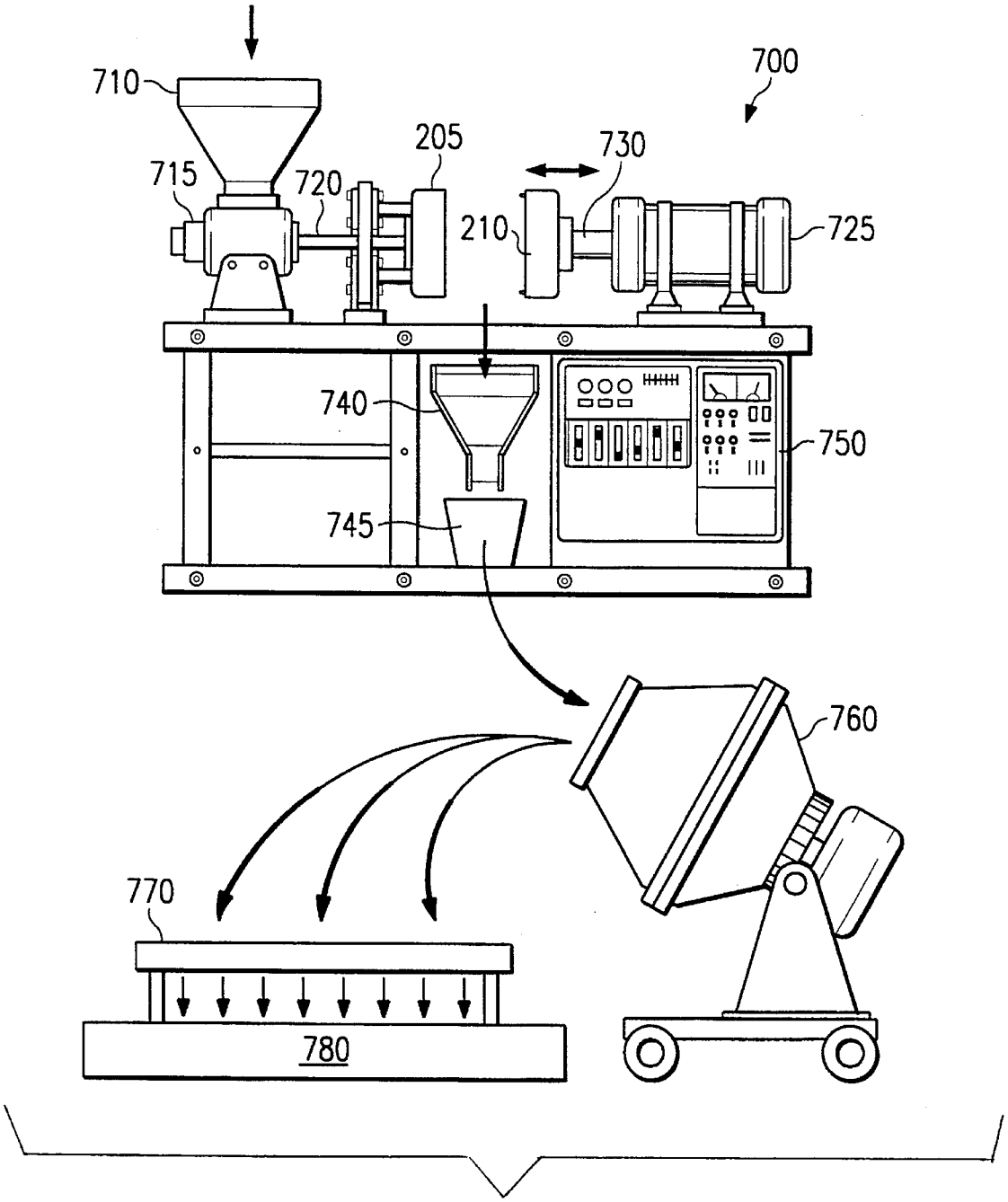
FIG. 7 is a depiction of a high speed die casting machine embodying the present invention.

FIG. 7 depicts a high speed casting machine, such as a Horla DM250, that may be used to cast shot pellets in accordance with the present invention. Pure bismuth or bismuth and another metal are poured into hopper 710 in order to produce shot pellets of pure bismuth or bismuth alloy. The bismuth and other metal, such as tin, (if a bismuth alloy is desired) are heated in furnace 715 to produce molten bismuth alloy, which is injected through tube 720 into die blocks 205 and 210. For purposes of further discussion of FIG. 7, it will be assumed that a bismuth alloy is being used.

Prior to injection of the molten bismuth alloy, die blocks 205 and 210 are pressed together by ram 730 which is driven by motor 725. In one embodiment of the present invention, the bismuth alloy is heated to a temperature of approximately 600° Fahrenheit. Additionally, in one embodiment of the present invention, either stationary die block 205 or movable die block 210, or both, may be heated to a temperature of approximately 125° Fahrenheit in order to slow down the rate at which the bismuth alloy cools as it spreads through the die block. This helps to ensure that the molten bismuth alloy will spread to the farthest extremity of die face 100 before solidifying.

Furnace 715 draws approximately 6 ounces of molten bismuth alloy into a plunger and injects the alloy at 600 p.s.i. through tube 720 into sprue hole 220 (not shown) in stationary die block 205. The molten bismuth alloy then spreads through sprue channel 105 and into quadrants 101–104 of the shot pellet array. In some embodiments of the present invention, quadrants 102 and 103 are connected and quadrants 101 and 104 are connected to thereby form two halves on either side of sprue channel 105, rather than quadrants.

The interconnections between sprue channel 105 and the first row of shot pellets 110 connected to sprue channel 105 may be made slightly larger than the interconnections between individual shot pellets 110. This will allow the molten bismuth alloy to flow more quickly out of sprue channel 105 and into the first row of shot pellets 110.

After the molten bismuth alloy has been injected into the mated die blocks 205 and 210, the molten bismuth alloy is allowed to cool for a period of approximately 5 seconds. At that point, motor 725 withdraws ram 730, thereby moving movable die block 210 away from stationary die block 205. At the same time, ejector pins (not shown) in stationary die block 205 eject the shot pellet array from stationary die block 205, causing it to fall into chute 740 and into container 745.

The entire process is controlled by control unit 750, which may be used to vary the melting temperature in furnace 715, the heating temperature of die blocks 205 and/or 210, and the length of the time delay during which the molten bismuth alloy is allowed to cool in the die block before stationary die block 205 and movable die block 210 are separated.

After a sufficient amount of shot pellet array has been gathered in container 745, the shot pellet array is dumped into tumbling device 760, which contains tumbling media (not shown), such as large ball bearings, which are used to break up the shot pellet array into individual shoe pellets.

In other embodiments of the present invention, the shot pellet array may be moved directly from chute 740 to tumbling device 760 by an automated device, such as a conveyor belt. The shot pellet array is tumbled in tumbling device 760 for a sufficient period of time to break apart the individual shot pellets and to smooth off the flashing 760 between the individual shot pellets and to smooth away the small "nipples" formed when the vias connecting the shot pellets are broken.

The time required to complete the tumbling process varies from 10 minutes to a half hour depending on the size of the shot that is being cast. After a sufficient time period to allow the tumbling device 760 to break up the shot pellet array, the contents of tumbling device 760 are poured through sifter 770 to separate the individual shot pellets from the tumbling media and the pieces of sprue. The shot pellets then fall into container 780, which may contain a conveyor belt that moves the shot pellets to a classifier. As explained above, the classifier separates the spherical shot pellets from improperly formed shot pellets, such as broken shot pellets or hollow shot pellets that were flattened during the tumbling process.

Although the present invention and its advantages have been described in detail, it should be understood that various changes, substitutions and alterations can be made herein without departing from the spirit and scope of the invention as defined by the appended claims.

What is claimed is:

1. A method of manufacturing bismuth alloy shot pellets comprising the steps of:

heating a bismuth alloy to a molten state;

injecting the molten bismuth alloy into a die block, the die block consisting of two die halves having opposing die faces, wherein each die face contains a plurality of substantially hemispherical impressions that are aligned with associated substantially hemispherical impressions on the opposing die face so as to form substantially spherical cavities when the two die halves are brought together as a mated pair and wherein an least one of the hemispherical impressions of each said mated pair of hemispherical impression has an interconnection with at least one other hemispherical impression on the same die face, the interconnection allowing the molten bismuth alloy to flow between at least two of the spherical cavities;

waiting a predetermined period of time to allow the molten bismuth alloy to solidify into an array of shot pellets;

separating the two die halves; and ejecting the solidified shot pellet array from the die block.

2. The method as set forth in claim 1 further including the step of breaking the ejected shot pellet array into individual shot pellets.

3. The method as set forth in claim 2 wherein the step of breaking is performed by tumbling the shot pellet array in a vessel.

4. The method as see forth in claim 3 wherein the vessel contains ball bearings.

5. The method as set forth in claim 2 further including the step of separating substantially spherical shot pellets from imperfect shot pellets.

6. The method as set forth in claim 1 further including the step of heating at least one of the two die halves to cause the injected molten bismuth alloy to solidify more slowly.

7. The method as set forth in claim 1 wherein at least a portion of at least one die face is machined so that a gap separates at least a portion of the two die faces when the two die halves are brought together, the gap thereby allowing the injected molten bismuth alloy to flow across the die face between at least two of the spherical cavities.

8. The method as set forth in claim 1 wherein the shot pellet array comprises rows and columns of shot pellets.

9. The method as set forth in claim 8 wherein the rows and columns of shot pellets are interlaced.

10. The method as set forth in claim 1 wherein the interconnection between the hemispherical impressions is a via channel, the via channel thereby forming a via connecting two of the spherical cavities.

11. The method as set forth in claim 1 wherein the interconnection between the hemispherical impressions is a point of contact of the hemispherical impressions, the point of contact thereby forming a hole connecting two of the spherical cavities.

12. The method as set forth in claim 1 wherein the shot pellet array comprises four quadrants, each quadrant producing a separate array of pellets.

13. The method as set forth in claim 12 wherein each quadrant is approximately 3 inches by 4 inches.

14. The method as set forth in claim 12 wherein each quadrant produces a shot array having at least 150 No. 4 shot pellets.

15. The method as set forth in claim 12 wherein each quadrant produces a shot array having at least 120 No. 3 shot pellets.

16. The method as set forth in claim 12 wherein each quadrant produces a shot array having at least 90 No. 2 shot pellets.

17. The method as set forth in claim 12 wherein each quadrant produces a shot array having at least 80 No. 1 shot pellets.

18. The method as set forth in claim 12 wherein each quadrant produces a shot array having at least 70 BB shot pellets.

19. The method as set forth in claim 12 wherein each quadrant produces a shot array having at least 50 No. 4 Buckshot pellets.

20. The method as set forth in claim 12 wherein each quadrant produces a shot array having at least 40 No. 3 Buckshot pellets.

21. The method as set forth in claim 12 wherein each quadrant produces a shot array having at least 35 No. 2 Buckshot pellets.

22. The method as set forth in claim 12 wherein each quadrant produces a shot array having at least 30 No. 1 Buckshot pellets.

23. The method as set forth in claim 12 wherein each quadrant produces a shot array having at least 25 No. 0 Buckshot pellets.

24. The method as set forth in claim 12 wherein each quadrant produces a shot array having at least 20 No. 00 Buckshot pellets.

25. A method of die casting bismuth alloy shot comprising the steps of:

heating a bismuth alloy to a predetermined temperature to thereby melt the bismuth alloy;

injecting the molten bismuth alloy into a sprue hole in a die block, the sprue hole connected to a sprue channel in the die block, the die block consisting of two die halves having opposing die faces, wherein each die face contains a plurality of substantially hemispherical impressions that are aligned with associated substantially hemispherical impressions on the opposing die face so as to form substantially spherical cavities when the two die halves are brought together and wherein at least one of the hemispherical impressions on at least one die face has an interconnection with at least one other hemispherical impression to allow molten bismuth alloy to flow therebetween and wherein at least one hemispherical impression on at least one die face has an interconnection with the sprue channel;

waiting a predetermined period of time to allow the molten bismuth alloy to solidify into an array of shot pellets;

separating the two die halves; and ejecting the solidified shot pellet array from the die block.

26. The method as set forth in claim 25 further including the step of breaking the ejected shot pellet array into individual shoe pellets.

27. The method as set forth in claim 26 wherein the step of breaking is performed by tumbling the shot pellet array in a vessel.

28. The method as set forth in claim 27 wherein the vessel contains ball bearings.

29. The method as set forth in claim 26 further including the step of separating substantially spherical shot pellets from imperfect shot pellets.

30. The method as set forth in claim 25 further including the step of heating at least one of the two die halves to cause the injected molten bismuth alloy to solidify more slowly.

31. The method as set forth in claim 25 wherein at least a portion of an least one die face is machined so that a gap separates an least a portion of the two die faces when the two die halves are brought together, the gap thereby allowing the injected molten bismuth alloy to flow across the die face between at least two of the spherical cavities.

32. The method as set forth in claim 25 wherein the shot pellet array comprises rows and columns of shot pellets.

33. The method as set forth in claim 32 wherein the rows and columns of shot pellets are interlaced.

34. The method as set forth in claim 25 wherein the interconnection between the hemispherical impressions is a via channel, the via channel thereby forming a via connecting two of the spherical cavities.

35. The method as set forth in claim 25 wherein the interconnection between nee hemispherical impressions is a point of contact of the hemispherical impressions, the point of contact thereby forming a hole connecting two of the spherical cavities.

36. The method as set forth in claim 25 wherein the interconnection between the sprue channel and the at least one hemispherical impression is larger than the interconnection between the at least one hemispherical impression and the at least one other hemispherical impression.

37. The method as set forth in claim 25 wherein the shot pellet array comprises four quadrants, each quadrant producing a separate array of pellets.

38. The method as set forth in claim 37 wherein each quadrant is approximately 3 inches by 4 inches.

39. The method as set forth in claim 37 wherein each quadrant produces a shot array having at least 150 No. 4 shot pellets.

40. The method as set forth in claim 37 wherein each quadrant produces a shot array having at least 120 No. 3 shot pellets.

41. The method as set forth in claim 37 wherein each quadrant produces a shoe array having at least 90 No. 2 shot pellets.

42. The method as set forth in claim 37 wherein each quadrant produces a shot array having at least 80 No. 1 shot pellets.

43. The method as set forth in claim 37 wherein each quadrant produces a shot array having at least 70 BB shot pellets.

44. The method as set forth in claim 37 wherein each quadrant produces a shot array having at least 50 No. 4 Buckshot pellets.

45. The method as set forth in claim 37 wherein each quadrant produces a shot array having at least 40 No. 3 Buckshot pellets.

46. The method as set forth in claim 37 wherein each quadrant produces a shot array having at least 35 No. 2 Buckshot pellets.

47. The method as set forth in claim 37 wherein each quadrant produces a shot array having at least 30 No. 1 Buckshot pellets.

48. The method as set forth in claim 37wherein each quadrant produces a shot array having at least 25 No. 0 Buckshot pellets.

49. The method as set forth in claim 37 wherein each quadrant produces a shot array having at least 20 No. 00 Buckshot pellets.

* * * * *